US005422638A

United States Patent [19]

Singer et al.

[11] Patent Number: 5,422,638

[45] Date of Patent: Jun. 6, 1995

[54] STAND FOR A REMOTELY OPERATED ROAD SIGN

[75] Inventors: Samuel Singer, Indiana; Harry Krasnikoff, Creekside; Richard E. Miller, Homer City; Frank C. Elling, Mahaffey, all of Pa.

[73] Assignee: Quintech, Inc., Indiana, Pa.

[21] Appl. No.: 201,441

[22] Filed: Feb. 24, 1994

Related U.S. Application Data

[63] Continuation-in-part of Ser. No. 955,082, Oct. 1, 1992, abandoned.

[51] Int. Cl.[6] ..... E01F 9/012

[52] U.S. Cl. ..... 340/908.1; 116/63 P; 40/610

[58] Field of Search ..... 340/908, 908.1, 471, 340/473, 825.69, 825.72; 307/10.8; 116/63 P; 40/610, 612; 448/122, 125

[56] References Cited

U.S. PATENT DOCUMENTS

| | | | |
|---|---|---|---|
| 1,553,046 | 9/1925 | Keen | 116/63 R |
| 2,603,698 | 7/1952 | Rieder | 340/908 |
| 2,806,670 | 9/1957 | Straster | 116/63 R |
| 2,829,362 | 4/1958 | Terrill | 340/908 |
| 2,941,185 | 6/1960 | Mullikin | 340/908 |
| 3,046,521 | 7/1962 | Cantwell et al. | 340/908 |
| 3,757,291 | 9/1973 | Lilly | 340/908 |
| 3,798,592 | 3/1974 | Lilly | 340/908 |
| 3,867,718 | 2/1975 | Moe | 340/908 |
| 4,613,847 | 9/1986 | Scolari | 340/473 |
| 5,038,136 | 8/1991 | Watson | 340/433 |

FOREIGN PATENT DOCUMENTS

| | | | |
|---|---|---|---|
| 3722823 | 1/1989 | Germany | 340/473 |

*Primary Examiner*—Hezron E. Williams
*Assistant Examiner*—Christine K. Oda
*Attorney, Agent, or Firm*—Richard V. Westerhoff; Jonathan J. Wainer

[57] ABSTRACT

A conventional STOP/SLOW traffic control sign mounted on a pole is supported and remotely operated by a portable stand having a tubular support mounted on a foldable frame which also carries a remotely controlled drive assembly so that the sign can be operated at a safe distance even by a person with disabilities.

15 Claims, 5 Drawing Sheets

STAND FOR A REMOTELY OPERATED ROAD SIGN

CROSS REFERENCE TO RELATED APPLICATION

This is a continuation-in-part of application Ser. No. 07/955,082, which was filed Oct. 1, 1992, now abandoned, and entitled "Stand for a Remotely Operated Road Sign."

BACKGROUND OF THE INVENTION

1. Field of the Invention

This invention relates to a stand for supporting and remotely operating a road sign, and in particular to a foldable stand for a remotely operated STOP/SLOW sign.

2. Background Information

It is common on road construction projects, or work zones, to periodically stop traffic through a restricted area or to alternate traffic on a single lane through the restricted area. Typically, a worker is positioned at each end of the restricted area with a sign mounted on a pole which the worker rotates between one face which displays a STOP sign to the oncoming traffic, and the opposite face which displays a SLOW sign. It is common for the sign operators, or flaggers, to coordinate the orientation of the signs at the two ends of the restricted area using radio communications. These sign operators normally stand in the traffic lane of the highway where they are in danger from both oncoming traffic and construction equipment, and exposure to exhaust fumes, construction byproducts and the elements. The sign operators are also standing on their feet for long periods of time on hot pavement which can lead to fatigue and loss of concentration.

There is a need for signs which can remove the sign operators from the dangers presently associated with the occupation.

There is also a growing interest in finding jobs in the construction industry for persons with disabilities. The Americans with Disabilities Act mandates that a person cannot be excluded from a job because of their disbility if they could be reasonably accomodated. While many of the construction jobs have heavy physical demands, the sign operator position does not have great physical demands, but does presently expose the person to danger.

SUMMARY OF THE INVENTION

It is an object of the present invention to provide an improved signaling system for controlling traffic at construction sites.

It is a principal object of the invention to provide such an improved traffic control signaling system for a construction site which reduces the danger to persons operating the sign.

It is an important object of the invention to provide such a signaling system which can be safely and conveniently operated by persons with disabilities.

These and other objects are realized by the invention which is directed to a stand for supporting and remotely controlling signs such as the STOP/SLOW signs used at highway construction sites and other work zones. More particularly, it is directed to a portable stand for supporting and remote operation of the conventional STOP/SLOW sign on a pole. Preferably, the stand is foldable for transport and storage between uses.

Specifically, the stand includes a tubular support in which the pole of the road sign is supported for rotation. The tubular support is mounted by a frame in a generally upright position. Motive means, such as a motor mounted on the frame, provides a motive force for rotating the pole of the sign to selectively display the STOP and SLOW sign faces. This motive means can be controlled from a location removed from the immediate area around the stand.

Preferably, the frame is foldable, and includes an assembly supporting the tubular support and including an elongated body extending therefrom. A pair of leg members are hinged at a first end of the assembly, and preferably to one end of the elongated body, for movement between a folded position alongside the elongated body and an open position wherein they angularly extend from the elongated body, preferably at about 120° in a Y-shape. The tubular support is preferably supported at the same end of the elongated body at which the leg members are hinged. The foldable frame further includes brace members connected between remote ends of the elongated body and the two leg members and the upper end of the tubular support. The brace members can be connected to the tubular members by movable sleeves which are stacked on the tubular support. In one preferred embodiment of the invention, the connection of the brace members to the tubular support permits the brace members to break away from the tubular support when the stand is hit by a vehicle travelling at a high rate of speed. In another embodiment, the connection of the brace members to the tubular support permits the sleeves to slide up or down the tubular support when the stand is similarly struck by a vehicle.

The leg members of the foldable frame are preferably C-channels which are hinged to the elongated body by hinge pins through the channel flanges so that the C-channels nest against the elongated member in the folded position. The webs of the channels bear against the end of the elongated member to form stops for the leg members in the open position. A resilient member such as a spring or a bungee cord connected between the leg members biases them to the open position and also to the folded position.

Mounting means for the tubular support, the motor and the remote control unit includes a planar member secured along one edge to the elongated member and extending upward between the folded C-channels. A horizontal plate secured on top of this planar member supports the tubular support and motor over the apparent center of the Y-shape formed by the elongated body and leg members with the latter in the open position. The legs can fold tightly against the elongated member because the mounting means is entirely above the legs.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
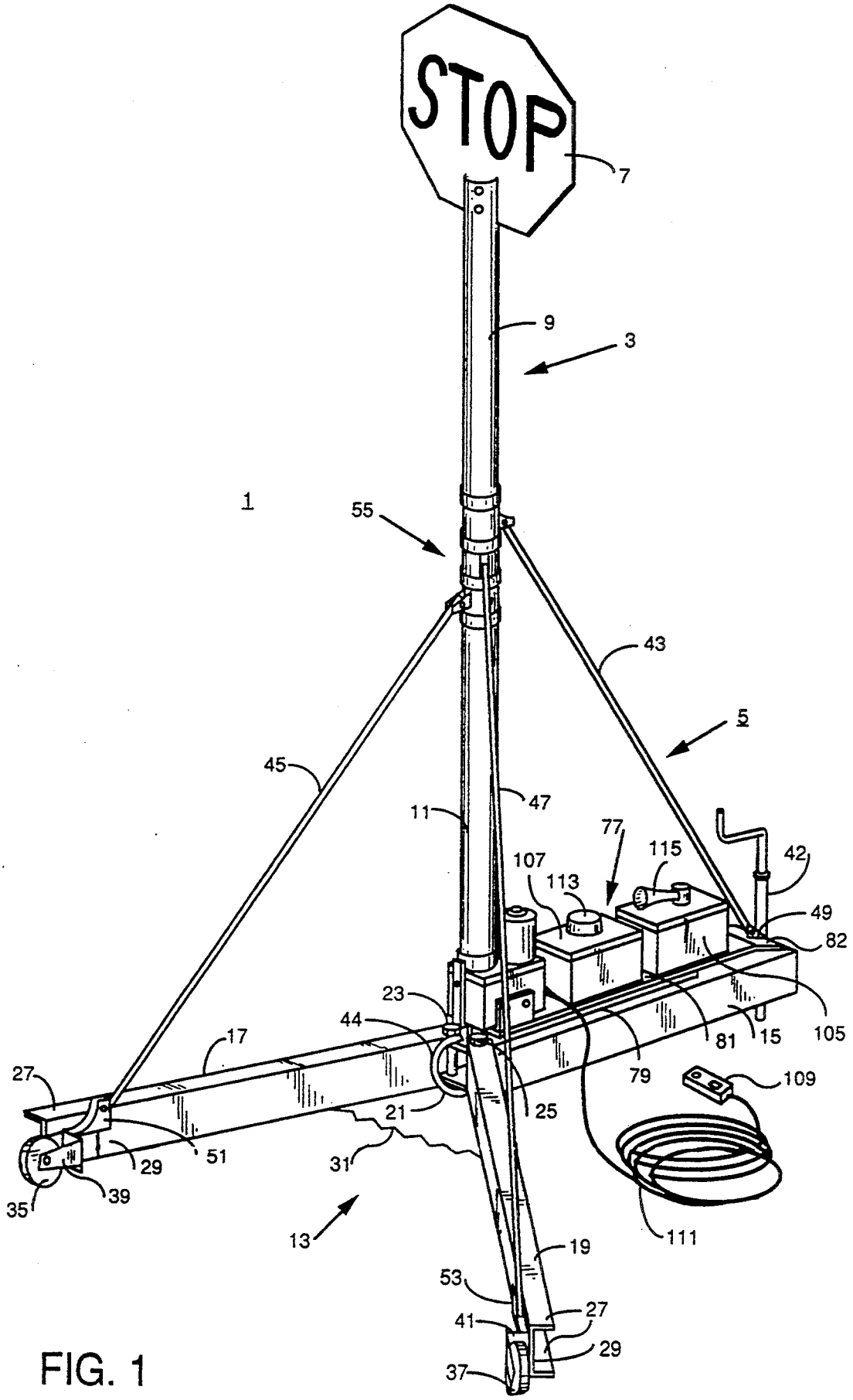
FIG. 1 is an isometric view of a stand in accordance with the invention shown in the open position with a sign in place.
Figure 2:
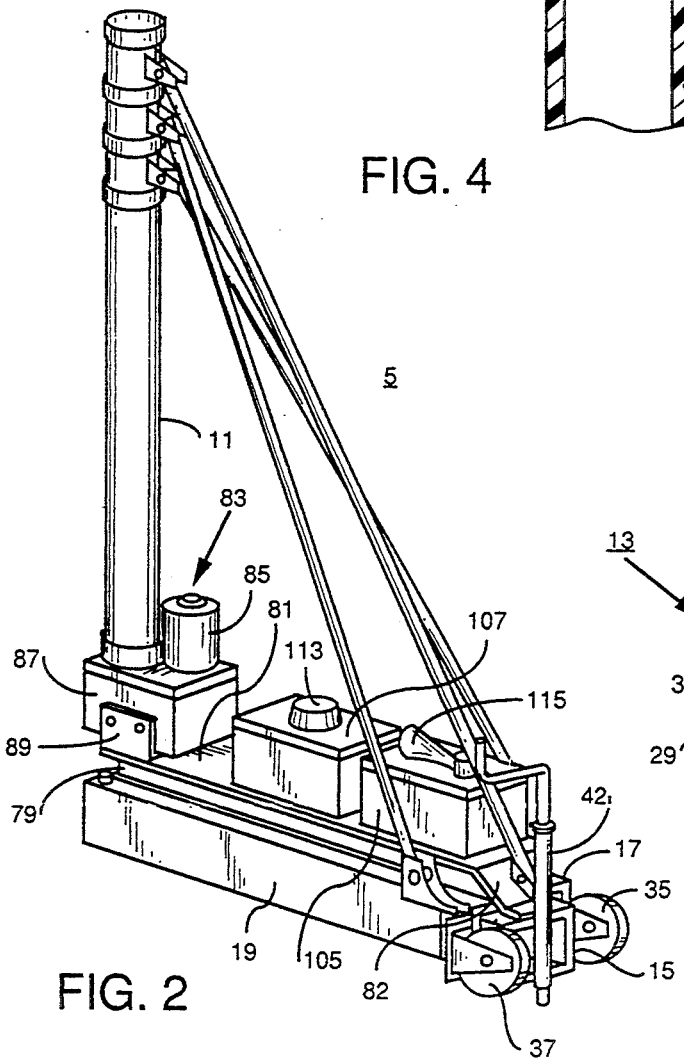
FIG. 2 is an isometric view of the stand of FIG. 1 in the folded position.
Figure 3:
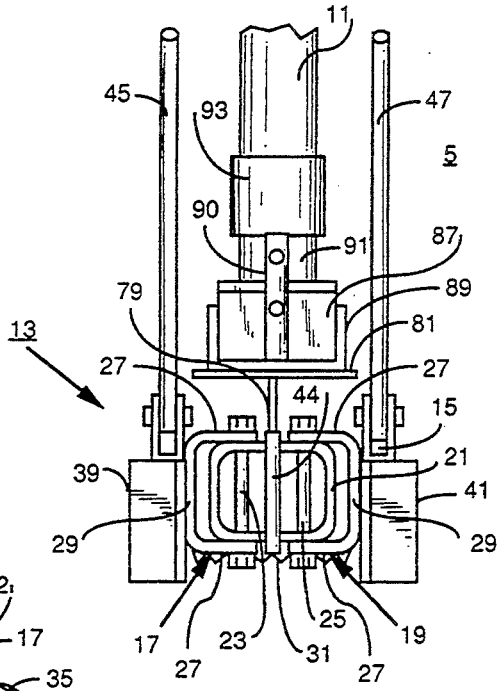
FIG. 3 is an end view of the folded stand.

Referring to FIGS. 1–3, the sign assembly 1 in accordance with the invention includes a conventional STOP/SLOW traffic control sign 3 and a portable, foldable sign stand 5. The sign 3 is a conventional sign having a planar (typically sheet metal) sign member 7 with the word STOP displayed on one face and SLOW displayed on the opposite face. The sign member 7 is mounted on the end of a pole 9 which is commonly a tubular member such as a section of PVC pipe with an outside diameter of, for instance, 1½ inches. Conventionally, a sign operator holds the pole 9 with the lower end resting on the ground and rotates it to selectively display the STOP and SLOW sign faces.

The portable, foldable stand 5, in accordance with the invention, permits the sign 3 to be operated remotely from a safe position off the roadway and greater than an arm's length distance, or about three feet, from the stand, which provides the opportunity for persons with disabilities to be employed in the construction field. Optimally, the operator will be positioned at least half the width of the roadway distant from the stand, and thus completely removed from traffic on the roadway when the stand is positioned on the same. The stand 5 also protects the sign operator, whether a person with disabilities or not, from the dangers conventionally associated with operating such a traffic control sign.

The stand 5 includes a tubular support 11 having an inside diameter sufficient to receive the pole 9 of the sign 3 and permit the free rotation thereof. The stand 5 also includes a foldable frame 13. The foldable frame 13 includes an elongated body 15 which may be a structural box member, and preferably a square steel pipe section. A pair of leg members 17 and 19 are pivotally connected to one end 21 of the elongated body 15 by hinge pins 23 and 25, respectively. Each of the leg members 17 and 19 is a C-channel section which includes a pair of flanges 27 joined by a web 29. The hinge pins 23 and 25 are located on the elongated body 15 and extend through the flanges 27 such that the C-channel leg members 17 and 19 may be pivoted between a folded position in which the C-channels nest with the flanges 27 overlapping the elongated body 15 as seen in FIGS. 2 and 3, and an open position as shown in FIG. 1 in which the leg members 17 and 19 extend angularly from the elongated body 15, generally forming a Y-shape. The hinge pins 23 and 25 are further located on the elongated body 15 such that the webs 29 bear against the end 21 of the elongated body 15 to form a stop for the leg members in the open position. A resilient member 31, such as a spring or a bungee cord, is connected between the leg members 17 and 19 at a point spaced from the hinge pins 23, 25 to bias the web 29 of the C-channels of the leg members against the end face 21 of the elongated body 15 with the leg members in the open position, and to bias the leg members into the nested position with the legs folded. The spring 31 causes the leg members to toggle between the open and folded positions as the legs pass through the 90° position relative to the elongated body 15.

Wheels 35 and 37 are mounted on the free ends of the leg members 17 and 19 by brackets 39 and 41 welded to the webs of the leg members 17 and 19, respectively. A leveling jack 42 is welded to the free end of the elongated body 15. With the frame 13 folded, it can be grasped by the handle 44, tipped, and rolled into position on the wheels 35 and 37. However, it is important to note that the wheels 35, 39 are not in contact with the ground when the stand 5 is in the open position. Instead, the leg members 17 and 19 are supported at their free ends by brackets 39 and 41, respectively. This arrangement prevents the stand from rolling a long distance if hit by a runaway vehicle, or from accidentally rolling down a sloped roadway.

Figure 4:
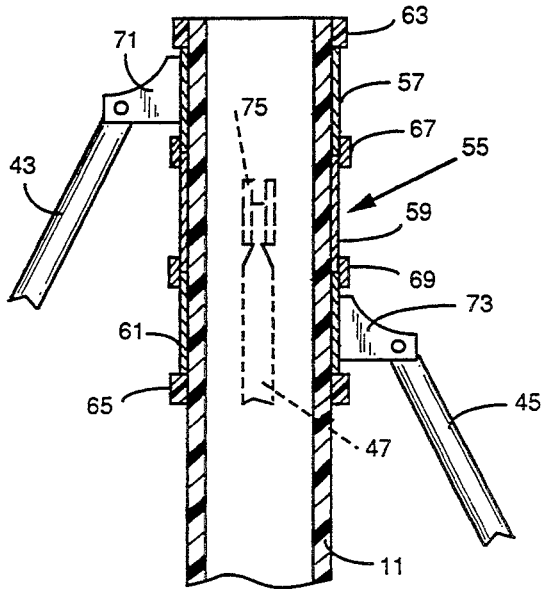
FIG. 4 is a vertical section through the upper portion of the tubular support which forms part of the stand of FIGS. 1 and 2 illustrating the rotating connections for the tubular support braces.

The stand 5 further includes three brace members 43, 45 and 47 which are preferably tubes secured at a lower end by clevises 49, 51, and 53, respectively, to the free ends of the elongated body 15, and the leg members 17 and 19. The upper ends of the braces 43, 45 and 47 are rotatably secured adjacent the upper end of the tubular support 11 by a rotatable coupling 55. As seen more clearly in FIG. 4, this rotatable coupling 55 includes three sleeves 57, 59 and 61 stacked on top of one another for rotation about the upper end of the tubular support between upper and lower retainer rings 63 and 65 secured by, for example, an adhesive or set screws (not shown). The lower ends of the two upper sleeves 57 and 59 have rings 67 and 69 secured thereto having an inside diameter which is the same as the outside diameter of the sleeve. These rings 67 and 69 form collars which telescope over the upper ends of the sleeves 59 and 61, respectively.

The upper ends of the brace members 43, 45 and 47 are respectively pinned to clevises 71, 73 and 75, respectively welded to the sleeves 57, 59 and 61. These brace members 43, 45, 47 provide lateral support for the upper end of tubular support 11 in each of the open and closed positions and all positions therebetween. As the leg members 17 and 19 are rotated between the open and folded positions, the sleeves 59 and 61 freely rotate about the tubular support 11 and the sleeve 57. Alternatively, the upper support for the brace member 43 connected to the elongated body 15 does not need to be rotatable.

One or both of the retainer rings 63, 65 can be adjustably loosened from the tubular support 11 under the force of an impact from a high speed vehicle such that each of the sleeves 57, 59 and 61 are free to slide up or down the tubular support 11 in response to the impact. This can be done, for example, by adjusting set screw 68 to a selected tightening force. This arrangement can allow the braces to absorb more of the energy of the impact and also can help prevent tipping of the stand.

Figure 9:
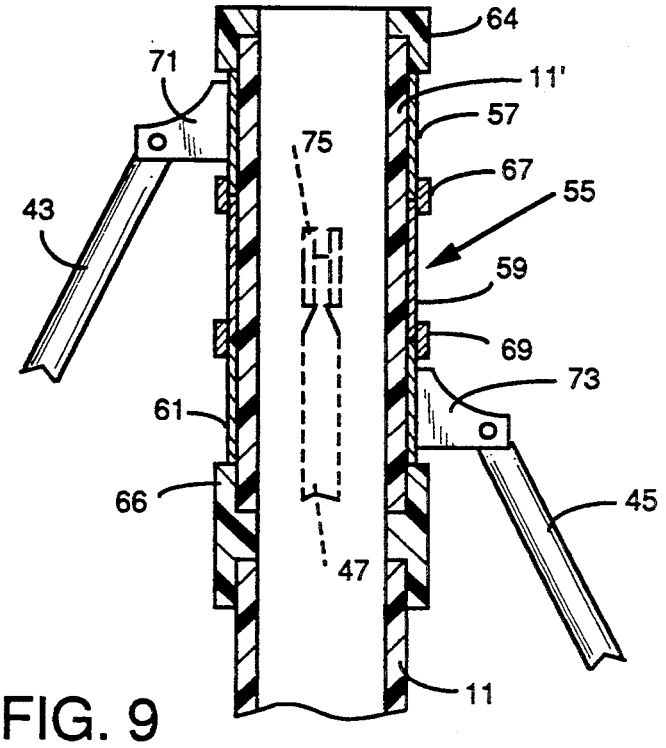
FIG. 9 is a vertical section through the upper portion of the tubular support illustrating an embodiment of the invention different from that illustrated in FIG. 4.

A different arrangement for connecting the brace members 43, 45 and 47 is illustrated in FIG. 9. In this embodiment of the invention, the tubular support 11 terminates at a point below the sleeve 61. Retainer 66 includes an inner annular ring that fits on top of tubular support 11. An additional, short section of tube 11' having the same inner diameter as the tubular support 11, and to which the sleeves 57, 59 and 61 are mounted, fits on top of retainer 66. Retainer 64 serves as a cap on top of tube 11'. An adhesive can be used between retainer 66 and support 11 and tube 11'.

Under the force of a low speed impact with a vehicle, for example with a vehicle travelling no more than about 35 mph, braces 45 and 47 (which normally are in the open, Y-shape, position facing oncoming traffic) will bear the brunt of the impact. The impact will force leg members 17 and 19 towards the closed position, but the resilient member 31 will prevent the stand from folding completely. The resilient member 31 then springs the leg members 17, 19 back to the Y-shape open position. Although the braces 45 and 47 may deform, the stand will generally remain upright, slide a short distance away and not interfere with the safe stopping of the vehicle.

Under the force of a higher speed vehicle impact in excess of a preselected speed, for example, a speed greater than about 35 mph, this arrangement permits the stand to more readily collapse and slide under the vehicle. In this case, leg members 45 and 47 may deform to a greater extent, thereby causing tube 11' to break away from the support tube 11. An impact from an automobile travelling at a very high speed, for example, in excess of about 60 mph, can cause greater damage to the frame. In all cases, damage to the vehicle generally will not be extensive, such damage generally involving only the front bumper, grill, hood and windscreen.

The stand 5 further includes a mounting assembly 77 which includes a planar member in the form of a plate 79 welded along a lower edge to the center line of the elongated body 15. The width of the elongated body 15 is sufficient such that the C-channels of the leg members 17 and 19 can nest against the elongated body 15 with the leg members 17 and 19 in the folded position without interfering with the planar member 79 (see FIG. 3). The planar member 79 is spaced from the one end 21 of the elongated body member 15, to provide clearance for the bias member 31. A support plate 81 is welded to the top edge of the planar member 79 and extends forward to the end 21 of the elongated body member 15. The support plate 81 is raised above the elongated body member 15 to enable the leg members 17 and 19 to tightly fold up against the elongated body member 15. The rear end 82 of the plate 81 is bent downward and welded to the elongated body member 15 for lateral stiffening.

Figure 6:
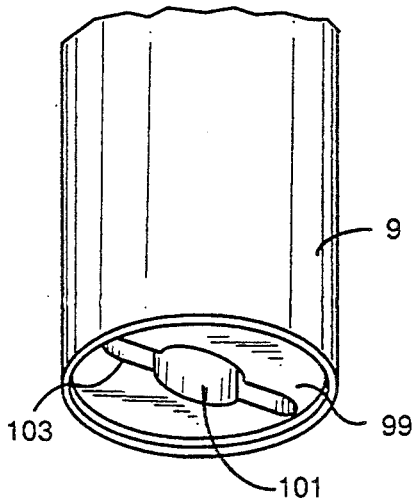
FIG. 6 is an isometric view with parts broken away illustrating the fitment on the sign pole which engages the drive motor coupling.

A drive assembly 83 includes a dc motor 85 with an integral gear box 87 mounted by a U-shaped bracket 89 and an L-shaped end brace 90 on the support plate 81 adjacent the end 21. The gear box 87 has a boss 91 extending upward adjacent the motor 85 (see FIG. 4). The lower end of the tubular support 11 is secured to this boss 91 by a pipe coupling 93. The gear box 87 has an output shaft 95 with a transverse drive pin 97 centered in the boss 91. A coupling 99 recessed and secured in the bottom of the pole 9 of the sign 3 (see FIG. 6) has a central aperture 101 intersected by a transverse slot 103 sized to engage the shaft 95 and drive pin 97, respectively, in the gear box. Thus, the conventional sign 3 with the keyed coupling 99 inserted and secured in the bottom of the tubular pole 9, is merely dropped into the tubular support 11 and engages the output shaft 95 and drive pin 97 so that when the motor is energized, the sign 3 is rotated. Alternatively, the output shaft 95 and drive pin 97 can be keyed in a single direction with the keyed coupling 99, i.e. polarized, such that the sign is always set up with the same angular orientation. For example, the transverse slot 103, instead of including two parts extending 180 degrees apart on opposite sides of the central aperture 101 as illustrated, can include a single part extending on one side only of the central aperture 101, or can include two parts extending less than 180 degrees apart.

Figure 10A:
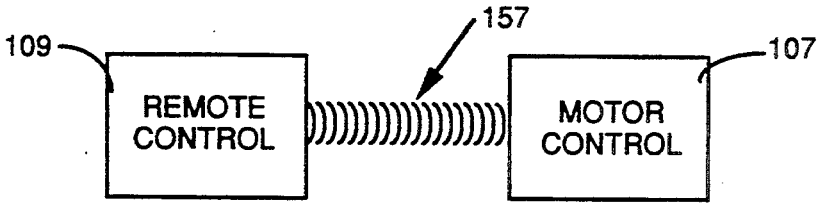
FIGS. 10*a*, 10*b* and 10*c* respectively illustrate embodiments of the invention wherein the remote control unit communicates with the motor control for the sign stand with a radio signal, an infrared signal and an acoustic signal.
Figure 10B:
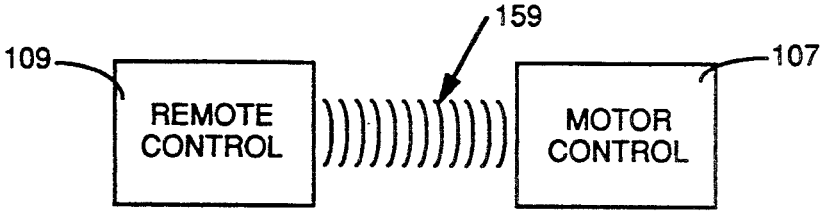
Figure 10C:
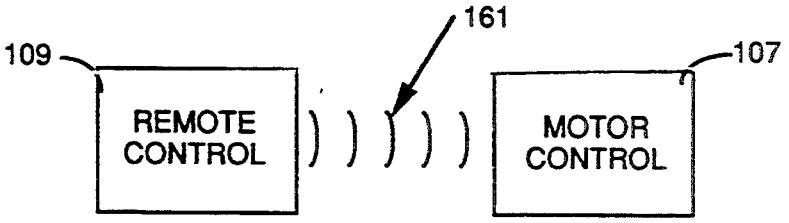

A battery 105 mounted on the support plate 81 supplies the power for the dc motor 85. The motor 85 is controlled by the motor control unit 107 which in turn is operated by a remote control unit 109. As shown, the remote control unit 109 is connected to the motor control 107 by a cable 111 for transmitting an electrical control signal. Alternatively, the remote control 109 can be linked to the motor control 107 through a wireless elecromagnetic signal, such as a radio control signal 157, as illustrated in FIG. 10*a*, or an infrared control signal 159, as illustrated in FIG. 10*b*. Additionally, the remote control unit 109 can couple to the motor control 107 through an acoustic control signal 161 as illustrated in FIG. 10*c*. Transmitters and receivers for each of the radio, infrared and acoustic signals are commonly available. In any case, the remote control unit allows the sign to be operated by an operator at a location removed from the dangerous proximity of the sign. This is especially useful for permitting the sign to be operated by a person with a disability, although it is in no way limited to a unit to be operated by such a person. It also permits a single operator to operate more than one sign and to receive feedback from multiple signs. For instance, an operator located where traffic at both ends of a one way zone could be observed could operate two signs regulating traffic in the two directions. The sign assembly 1 can also include a rotating or a flashing strobe light 113, a horn 115 and other features.

Figure 5:
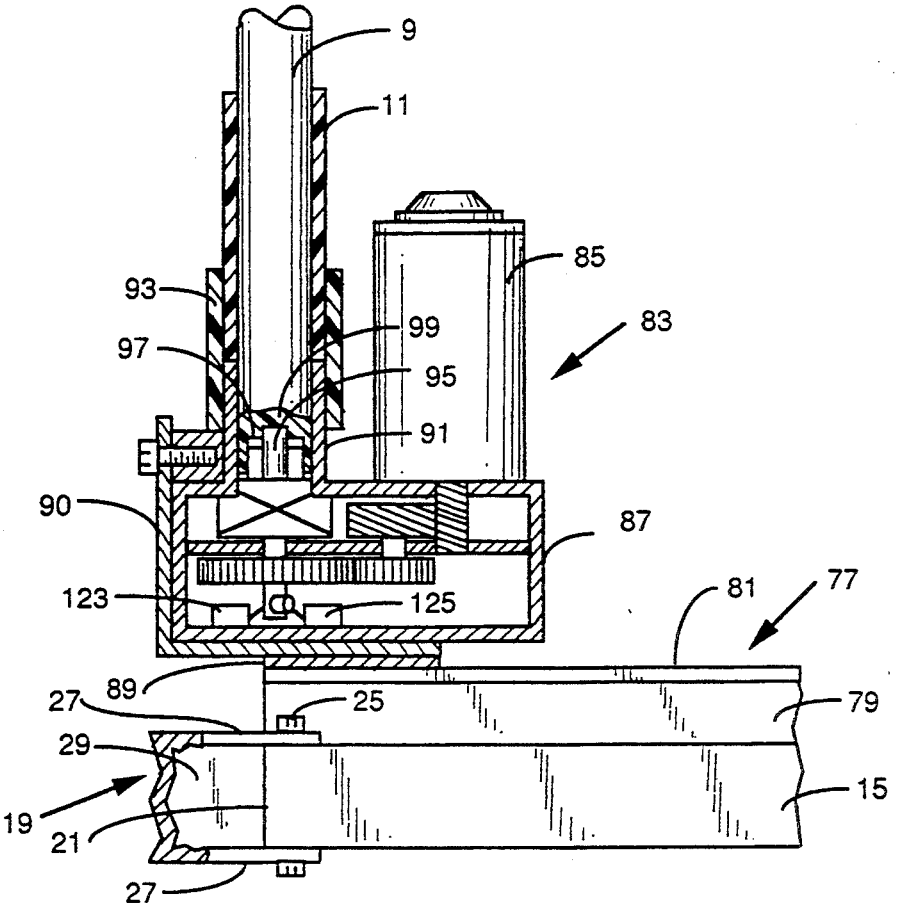
FIG. 5 is a vertical section through the lower portion of the tubular support and gear box for the drive motor or the stand of FIGS. 1 and 2.
Figure 7:
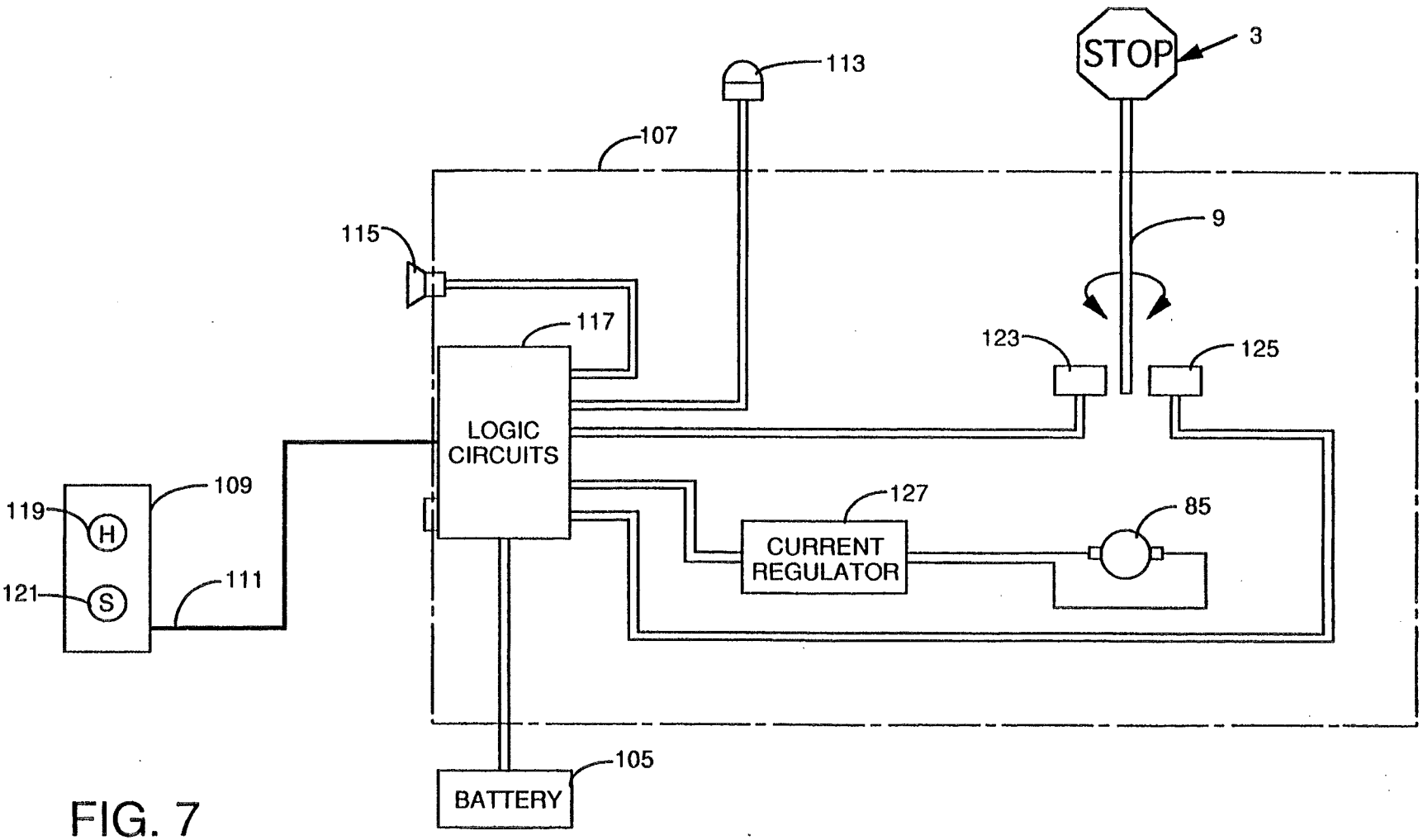
FIG. 7 is a block diagram of the electrical system for the stand.

FIG. 7 illustrates the electrical system for the stand 5. The control unit 107 which is powered by the battery 105 includes logic circuits 117 which control the dc motor 85, the strobe light 113, and the horn 115. The strobe light 113 can be programmed to operate continuously or on demand when the operator sees the need to gain the attention of the drivers. In the embodiment illustrated, the horn is operated by a push-button 119 on the remote control 109 while the sign is cycled between the SLOW and STOP positions by successive actuation of a push-button 121. A SLOW limit switch 123 and STOP limit switch 125 are mounted in the gear box 87 (see FIG. 5) and are actuated, respectively when the sign reaches the SLOW and STOP positions. A regulator 127 regulates the current supplied to the dc motor 85.

Figure 8:
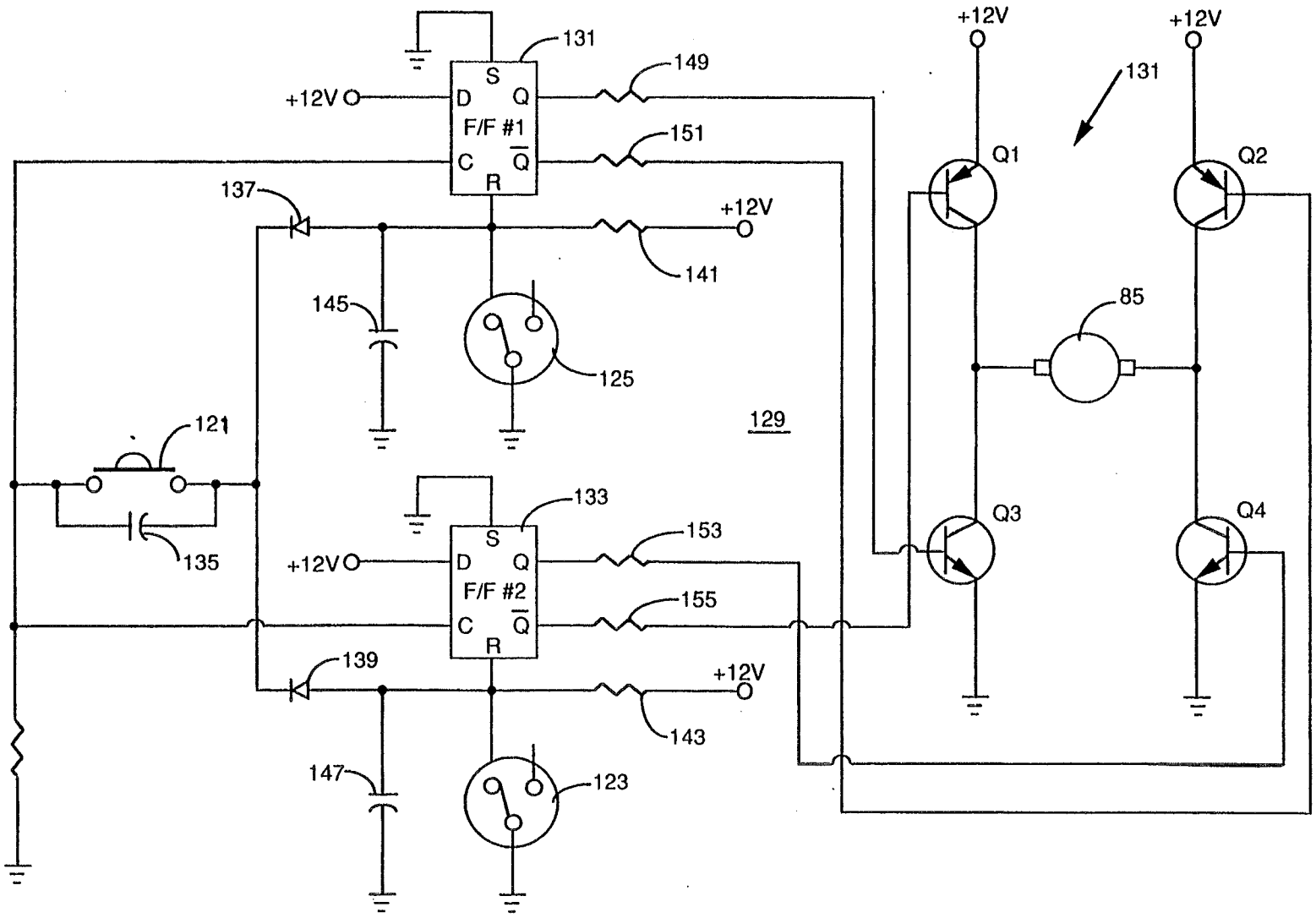
FIG. 8 is a schematic circuit diagram of the logic circuit which forms part of the electrical system of FIG. 7.

A suitable logic circuit 129 for controlling the dc motor 85 is shown in FIG. 8. The motor 85 is energized by a transistor bridge 131 which includes pnp transistors Q1 and Q2 and npn transistors Q3 and Q4. The transistors Q3 and Q2 are controlled respectively by the complimentary outputs Q and $\overline{Q}$ of a flip-flop 131, while the transistors Q4 and Q1 are similarly controlled by the complimentary outputs Q and $\overline{Q}$ of a second flip-flop 133. The flip-flops 131 and 133 are both D-type flip-flops having the 12 volt supply from the battery applied to their data (D) inputs. The STOP limit switch 125 is connected to the reset (R) input of the flip-flop 131 and the SLOW limit switch 123 is connected to the R input of the flip-flop 133. The clock inputs (C) of the flip-flops 131 and 133 are both connected to the sign push-button 121 which is protected by a noise suppressing capacitor 135.

The push-button 121 is enabled by either the STOP limit switch 125 or the SLOW limit switch 123 through the diodes 137 and 139, respectively. Both of the limit switches 123 and 125 are normally closed. These switches are connected to ground so that with both limit switches closed, the push-button 121 is disabled. The STOP limit switch 125 opens when the sign reaches the position in which the STOP face of the sign is facing oncoming traffic. With STOP limit switch 125 open, power is supplied to the push-button 121 through pull up resistor 141 and diode 137. Similarly, when the sign reaches the position in which the SLOW side is facing oncoming traffic, the switch 123 opens and the push-button 121 is enabled through the pull up resistor 143 and the diode 139. Noise suppressing capacitors 145 and 147 are provided across the switches 125 and 123, respectively.

The reset input R of the flip-flop 131 goes high when the STOP limit switch 125 opens. This causes the Q output of 131 to go low and the $\overline{Q}$ to go high. Under these conditions, the transistors Q3 and Q2 are off. When the push-button 121 is enabled by the opening of the SLOW limit switch 123, actuation of the button 121 causes the clock input, C, of the flip-flop 131 to go high thereby changing the state of the flip-flop so that the Q output goes high and the $\overline{Q}$ output goes low. The high state of the Q output provides base drive current through resistor 149 to the transistor Q3. At the same time, the low state of the $\overline{Q}$ output of the flip-flop 131 provides a sink through resistor 151 for base drive current for the transistor Q2. With Q2 and Q3 turned on, a circuit is completed for operating the motor to turn the sign to present the STOP face.

In a similar manner, opening of the SLOW limit switch 123 applies a reset signal to the flip-flop 133 causing the Q output to go low and the $\overline{Q}$ output to go high. This turns off the transistors Q4 and Q1. When the reset input is high, the clock input is blocked from changing state of the flip-flop. However, with the reset input R of flip-flop 133 low, a high signal on the clock input, C, causes the flip-flop 133 to change state. When the Q output of flip-flop 133 is high and the $\overline{Q}$ output is low, base drive currents are provided through resistors 153 and 155 to turn on transistors Q4 and Q1 to operate the motor to turn the sign to present the SLOW face.

In operation, the circuit of FIG. 8 causes the motor 85 to cycle the sign between presentation of the STOP and SLOW faces on successive actuations of the push-button 121. Assume for a moment that the sign is at the STOP limit so that STOP switch 125 is open and the STOP face is presented to oncoming traffic. Under these conditions, the reset input R to the flip-flop 131 is high so that the Q output is low and $\overline{Q}$ output is high, thus, the transistors Q3 and Q2 are off. The SLOW limit switch 123 will be closed, and therefore the reset input R of flip-flop 133 will be low. At this point, the Q output of the flip-flop 133 is low and the $\overline{Q}$ is high so that the transistors Q4 and Q1 are also off. Thus, all of the transistors are off and the motor is de-energized with the sign in the STOP position. The push-button 121 is enabled by the open STOP limit switch 125.

If the operator now actuates the push-button 121, the clock inputs to both flip-flops 131 and 133 go high. This clock signal has no effect on the flip-flop 131 which is held in the reset position by the STOP limit switch 125. However, the clock signal causes the Q output of the flip-flop 133 to go high and the $\overline{Q}$ output to go low. This turns on the transistors Q4 and Q1 turning on the motor 85 and causing it to rotate the sign from the STOP position to the SLOW position. Once the sign begins to rotate out of the STOP position, the STOP limit switch 125 closes to disable the push-button 121.

When the sign reaches the SLOW position, the SLOW limit switch 123 opens. This causes the R input to the flip-flop 133 to go high thereby resetting flip-flop 133 and turning off the transistors Q4 and Q1 while re-enabling the push-button 121. The sign then remains in the SLOW position with the motor de-energized until the operator again pushes the push-button 121. This actuation of the push-button 121 applies the clock signal to the flip-flop 131, thereby turning on the transistors Q3 and Q2 causing the motor to reverse direction and turn the sign back to the STOP position. Thus, each successive actuation of the push-button 121 causes the sign to change from one side to the other.

An alternative control can have separate STOP and SLOW buttons (not shown), instead of the single push button 121 used in the above-described embodiment. In order that the sign always faces in the proper direction, it is necessary to provide a polarized keyed coupling 99 at the bottom of the pole 9 to couple to a mating, polarized motor shaft 95 and drive pin 97 such that there is a single preferred rotational orientation.

In another embodiment of the invention, a multiple sign system can be controlled by a single operator with a single remote control unit. This would be used, for example, in a situation where traffic can only proceed in one direction at a time for a limited distance that is substantially visible to the operator. A STOP/SLOW sign stand of the present invention would be placed at each end of the restricted area, each within clear view of the operator, either by line-of-sight or by remote means. A control unit for a system such as this can have a common STOP button and two SLOW buttons (SLOW1 and SLOW2), one for each sign (SIGN1 and SIGN2). The initial state of the system would have both signs indicating STOP to traffic. Pushing, for example, the SLOW1 button would turn SIGN1 to show SLOW to traffic while SIGN2 continues to show STOP. Pushing the SLOW2 button would turn SIGN1 to STOP and SIGN2 to SLOW. Again pushing the SLOW1 button would reverse the orientation of each sign. Pushing the STOP button would move each sign to show the STOP to traffic. Indicator lamps can be used to indicate the state of each sign to the operator. The controller may have an interlock to prevent both signs from indicating SLOW to traffic at the same time. An override button can be provided to override the interlock, allowing both signs to indicate SLOW to traffic.

Other features can be added to the remotely controlled traffic sign in accordance with the invention. For instance, the modular logic circuit of FIG. 8 can be interconnected with logic circuits for multiple signs so that a single operator can control more than one sign and/or to make feedback from multiple signs available to each operator at any location. This is an important feature for use at complex intersections. Optional motion detection and alarms can be added in the STOP mode to detect motion of vehicles in a queue and sound an alarm to alert the operator of possible danger. Such a motion detector could utilize infrared sensing or ultrasound ranging. This option would be usable over a short range such as, for instance, 20 to 60 feet. As another option, a proximity/speed detector and alarms could be added to the STOP mode. Such a system could use remote sensing to provide the capability of detecting vehicle speed and distance and to alert the operator of approaching vehicles, and/or vehicles travelling at an excessive speed. This system would be usable over a medium range of, for instance, 50 to 500 feet.

The rugged, compact stand of the invention can be used to support and remotely operate other types of pole mounted signs in addition to STOP/SLOW road signs, for instance, signs with more than two faces, or signs which rotate continuously.

EXPERIMENTAL

An important feature of the stand is that it is designed with safety of automobile passengers and work zone personnel in mind. Impact tests of a passenger vehicle travelling at a variety of speeds prove that vehicle passengers will not be injured by flying debris after a crash, and that safe operation and control of the automobile will not be significantly impaired.

Full scale vehicle crash testing was conducted in accordance with NCHRP Project 22-2, *Recommended Procedures for the Safety Performance Evaluation of Highway Features*, Test 71, Work Zone Traffic Control Devices. Tests were conducted at crash speeds of 35 mph and 62 mph on a Portland Cement airport taxi apron under dry surface conditions. The vehicle used was a Volkswagen Golf, weighing about 1800 pounds with a wheelbase of 97 inches. The device tested was a Robostop model TCD 2000 stand weighing about 68 pounds, and having a brace arrangement similar to that illustrated in FIG. 4.

During the 35 mph test, the device frame moderately deformed, yet broke away from the vehicle and coasted a distance of 26 feet directly in front of the vehicle before coming to rest. On the 62 mph test, the device frame yielded and was carried under the test vehicle for the 213 ft stopping distance, but did not cause destabilization or loss of control of the vehicle. The vehicle driver reported no significant physical effect from the impact, such as a jolt or yaw to the vehicle or a jolt to the steering wheel. Due to the relatively low profile design of the test device, and the manner in which it deformed, there was no front-end pitch.

In each test, a plastic STOP/SLOW paddle mast yielded and struck, but did not pierce the windshield. No potential visual impairment to the driver was ever a factor due to the small size of the STOP/SLOW paddle.

On both test runs, the device frame remained on the ground, thus exhibiting no potential to intrude into the occupant compartment. Where the device rolled forward in the 35 mph test, it did so at a sufficiently slow speed so as not to present an appreciable danger to work zone personnel, especially in view of the risk posed by an errant vehicle.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A portable stand for a sign having a sign member mounted on a pole, said stand comprising:

a tubular support, supporting the pole of said sign; and a folding frame supporting said tubular support in a generally upright position, comprising:

an assembly supporting said tubular support and including an elongated body member extending generally horizontally therefrom; and a pair of leg members, each of said leg members attached at a first end to said assembly and pivoting in a generally horizontal plane between a folded position against said elongated body member and an open position angularly extending from said elongated body member;

a first brace member having one end connected adjacent an end of said elongated body member;

a second brace member having one end connected adjacent a second end of one of said leg members;

a third brace member having one end connected adjacent a second end of the other of said leg members; and connecting means connecting a second end of each said first brace member, said second brace member and said third brace member to said tubular support distal from said assembly.

2. The portable stand of claim 1 wherein said connecting means include means for releasing at least one of said first brace member, said second brace member and said third brace member from said tubular support in response to a vehicular impact to said foldable frame at a speed in excess of a preselected speed.

3. The portable stand of claim 1 wherein said connecting means includes movable sleeves stacked on said tubular support, means securing said second end of each of said first brace member, said second brace member and said third brace member to a different one of said sleeves, and retainers retaining said sleeves at a longitudinal position adjacent an upper end of said tubular support.

4. The portable stand of claim 3 wherein said connecting means include means for releasing at least one of said first brace member, said second brace member and said third brace member from said longitudinal position in response to a vehicular impact to said folding frame at a speed in excess of a preselected speed.

5. The portable stand of claim 3 wherein said sleeves each include a cylindrical body and two of said sleeves include a cylindrical collar on one end of said cylindrical body overlapping the cylindrical body of an adjacently stacked one of said sleeves.

6. The portable stand of claim 3 wherein said tubular support is segmented into a lower segment and an upper segment to which said sleeves are connected, and wherein said connecting means includes a retainer ring having an annular section supported on top of said lower segment and supporting said upper segment, for releasing at least one of said first brace member, said second brace member and said third brace member from said tubular support in response to a vehicular impact to said folding frame at a speed in excess of a preselected speed.

7. The portable stand of claim 1 wherein each of said leg members comprises a C-channel having a pair of flanges joined by a web, and a hinge pin pivotally connecting said flanges adjacent said first end of said leg member to one end of said elongated body member, said C-channel nesting with said elongated body member in said folded position.

8. The portable stand of claim 7 wherein said hinge pin of each of said leg members is positioned adjacent said one end of said elongated body member such that said web of said C-channel of each of said leg members abuts said one end of said elongated body member in said open position.

9. The portable stand of claim 8 wherein each of said leg members further includes resilient means connected to at least one of said flanges on said C-channel and spaced from said hinge pin to bias said leg member against said elongated body member in said folded position and to bias said web of said C-channel against said one end of said elongated body member in said open position.

10. The portable stand of claim 9 wherein said assembly further includes a planar support member secured on edge to said elongated body member spaced from said one end of said elongated body member and extending upward along said elongated body member between said C-channel of each of said leg members with said leg members in the folded position, and a plate member abutting an upper edge of said planar support member and cantilevered over said one end of said elongated body member, said tubular support being mounted on said plate member.

11. The portable stand of claim 7 wherein said assembly further includes a planar support member secured on edge to said elongated body member and extending upward along said elongated body member between said C-channel of each of said leg members with said leg members in the folded position and a plate member abutting an upper edge of said planar support member on which said tubular support is mounted.

12. The portable stand of claim 1, wherein the assembly comprises motive means for generating a motive force for rotating said pole in said tubular support between a first angular position and a second angular position, and means for receiving a control signal controlling said motive means.

13. The portable stand of claim 12, wherein the control signal is selected from the group of signals consisting of an electrical signal transmitted through a cable, a wireless electromagnetic signal, and an acoustic signal.

14. The portable stand of claim 12, wherein the control signal is generated from a location a safe distance from said frame.

15. The portable stand of claim 14, wherein said safe distance is greater than about three feet from said frame.

* * * * *